US008057730B2

(12) United States Patent
Suzuki

(10) Patent No.: US 8,057,730 B2
(45) Date of Patent: Nov. 15, 2011

(54) MICROFILAMENT MANUFACTURING METHOD AND MANUFACTURING APPARATUS THEREFOR

(75) Inventor: Akihiro Suzuki, Kofu (JP)

(73) Assignee: University of Yamanashi, Yamanashi (JP)

( * ) Notice: Subject to any disclaimer, the term of this patent is extended or adjusted under 35 U.S.C. 154(b) by 206 days.

(21) Appl. No.: 12/522,698

(22) PCT Filed: Jan. 9, 2008

(86) PCT No.: PCT/JP2008/050103
§ 371 (c)(1),
(2), (4) Date: Jul. 9, 2009

(87) PCT Pub. No.: WO2008/084797
PCT Pub. Date: Jul. 17, 2008

(65) Prior Publication Data

US 2010/0148406 A1 Jun. 17, 2010

(30) Foreign Application Priority Data

Jan. 9, 2007 (JP) ..... 2007-000964
Sep. 3, 2007 (JP) ..... 2007-227981

(51) Int. Cl.
*B29C 55/00* (2006.01)

(52) U.S. Cl. ..... 264/481; 425/66

(58) Field of Classification Search ..... 425/66; 264/481
See application file for complete search history.

(56) References Cited

U.S. PATENT DOCUMENTS

| | | | | |
|---|---|---|---|---|
| 1,812,592 | A * | 6/1931 | Herrmann | 425/66 |
| 1,975,504 | A | 10/1934 | Formhals | |
| 3,453,709 | A * | 7/1969 | Dyer | 425/66 |
| 4,030,901 | A * | 6/1977 | Kaiser | 65/424 |
| 5,582,843 | A * | 12/1996 | Sellars et al. | 425/71 |
| 6,551,545 | B1 * | 4/2003 | Hutter et al. | 264/555 |
| 7,101,504 | B2 * | 9/2006 | Suzuki | 264/481 |
| 2004/0098023 | A1 | 5/2004 | Lee | |
| 2005/0054254 | A1 * | 3/2005 | Erickson et al. | 442/340 |
| 2005/0067732 | A1 | 3/2005 | Kim | |
| 2006/0006585 | A1 | 1/2006 | Suzuki | |

(Continued)

FOREIGN PATENT DOCUMENTS

JP 2003-166115 6/2003

(Continued)

OTHER PUBLICATIONS

Supplementary European Search Report corresponding to European Patent Application No. 08702974.0-1217 / 2103723 dated Feb. 21, 2011.

(Continued)

*Primary Examiner* — Joseph S. Del Sole
*Assistant Examiner* — David N Brown, II
(74) *Attorney, Agent, or Firm* — Jenkins, Wilson, Taylor & Hunt, P.A.

(57) ABSTRACT

The objective of the present invention is to enable a microfilament that is a nanofilament to be manufactured continuously and consistently from all thermoplastic polymers without requiring a specialized high precision•high performance apparatus and also to present the nanofilament manufactured as described. The present invention comprises a microfilament in a nanofilament region and the manufacturing means thereof wherein a original filament transferred using a filament transfer means is supplied to an orifice under pressure P1 and is heated and drawn using an infrared light beam directly under the orifice under pressure P2 (P1>P2).

19 Claims, 13 Drawing Sheets

U.S. PATENT DOCUMENTS

2006/0182960 A1* 8/2006 Suzuki ..... 428/364

FOREIGN PATENT DOCUMENTS

| | | |
|---|---|---|
| JP | 2004-107851 | 4/2004 |
| JP | 2005-520068 | 7/2005 |
| JP | 2006-506171 | 2/2006 |
| JP | 2006-057228 A | 3/2006 |
| JP | 2006-225837 | 8/2006 |
| WO | WO2005-083165 | 9/2005 |
| WO | WO2008/084797 | 7/2008 |

OTHER PUBLICATIONS

You et al., "In Vitro Degradation Behavior of Electrospun Polyglycolide, Polylactide, and Poly(lactide-*co*-glycolide)," Journal of Applied Polymer Science, vol. 95, pp. 193-200 (2005).

Suzuki et al., "PET Microfiber Prepared by Carbon Dioxide Laser Heating," Journal of Applied Polymer Science, vol. 88, pp. 3279-3283 (2003).

Suzuki et al., "Nylon 6 Microfiber Prepared by Carbon Dioxide Laser Heating," Journal of Applied Polymer Science, vol. 92, pp. 1449-1453 (2004).

Suzuki et al., "Isotactic Polypropylene Microfiber Prepared by Carbon Dioxide Laser-Heating," Journal of Applied Polymer Science, vol. 92, pp. 1534-1539 (2004).

International Preliminary Report on Patentability corresponding to International Patent Application No. PCT/JP2008/050103 dated Jul. 29, 2008.

International Search Report corresponding to International Patent Application No. PCT/JP2008/050103 dated May 1, 2008.

* cited by examiner (A)

(B)

Ss=0.1m/min

Ss=0.2m/min

Ss=0.3m/min

Ss=0.4m/min

MICROFILAMENT MANUFACTURING METHOD AND MANUFACTURING APPARATUS THEREFOR

FIELD OF THE INVENTION

The present invention relates to microfilament manufacturing method and manufacturing apparatus therefore and the nanofilament obtained. More specifically, the present inventions relate to microfilament manufacturing means that enables the microfilament to be attenuated until it is nanofilament by achieving a super high draw ratio by irradiating using an infrared light beam.

BACKGROUND OF THE INVENTION

Fibers with fiber diameters smaller than 1 μm, that is, nanometer sized (from several nanometers to several hundreds of nanometers) fibers have gained attention in recent years as revolutionary materials of the future in a broad range of applications such as IT, bio, environmental and other applications. The nanofibers have typically been prepared using an electro-spinning method (henceforth sometimes abbreviated to "ES method"). (See U.S. Pat. No. 1,975,504; You Y., et al *Journal of Applied Polymer Science*, Vol. 95, p. 193-200, 2005.) However, the ES method is a complicated manufacturing method since polymer needs to be dissolved in solvent and the solvent must be removed from the product obtained. In addition, molecules lack orientation in the filament obtained, and many quality problems such as the presence of small resin particles, referred to as balls and shots were encountered in the fiber aggregates obtained.

The inventors previously invented a means to obtain microfilaments and non-woven fabrics using a super high draw ratio that exceeded one thousand through molecular orientation conducted according to an infrared method. (See Japanese Patent Publication No 2003-166115 and 2004-107851; International Publication No. WO2005/083165A1; Akihiro Suzuki and one other "*Journal of Applied Polymer Science*", Vol. 88, p. 3279-3283, 2003; Akihiro Suzuki and one other, "*Journal of Applied Polymer Science*", Vol. 92, p. 1449-1453, 2004; Akihiro Suzuki and one other, "*Journal of Applied Polymer Science*", Vol. 92, p. 1534-1539, 2004.) These are simple means, and microfilaments with molecular orientation and non-woven fabrics thereof were obtained. The present invention is a further development of the same theme and relates to a means that allows microfilaments to be manufactured continuously and consistently by enabling filaments to be attenuated into nanofilaments.

DISCLOSURE OF THE INVENTION

Problems to be Solved by the Invention

The present invention further develops the inventors' previous technology described above. The objective of the invention is to make it possible to readily obtain a filament comprising a microfilament that may be as small as a nanofilament and non-woven fabrics that is an aggregate thereof using a simple means without requiring a special high precision, high performance apparatus. Furthermore, the present invention relates to the nanofilaments obtained according to the manufacturing means of the present invention from large diameter filaments comprising polyesters such as poly(ethylene terephthalate), poly(ethylene naphthalate) and the like, biodegradable polymers such as poly(lactic acid), poly(glycolic acid) and the like, and fluorinated polymers such as tetrafluoroethylene.perfluoroalkyl vinyl ether copolymers (PFA) and the like and to present a non-woven fabrics used in diverse applications such as medical applications, filters and the like.

Means to Solve the Problem

The present invention presents a drawing method that draws an original filament and attenuates it into the nanofilament range and an apparatus therefore. The original filament in the present invention refers to a filament previously manufactured and wound on a reel and the like. In addition, a filament obtained by cooling a molten material or coagulating a dissolved material in a spinning step may become an original filament in the present invention subsequent to the spinning step. Here the filament refers to a basically continuous fiber and is distinguished from staple fiber that varies in length from several millimeters to several tens of millimeters. The original filament preferably exists individually, but several to several tens of filaments may be gathered and used.

The filaments drawn in the present invention are all referred to as filaments, and those characterized as nanofilament fibers mentioned above are also included. A filament drawn in the present invention is drawn for at least several minutes without breaking in most cases and can be considered a continuous filament with a small filament diameter, d. However, staple fibers characterized as nanofilament fibers mentioned above can be manufactured depending upon the conditions.

The filament of the present invention may be a single filament comprising one filament or a multi-filament comprising multiple filaments. As far as the tension and the like on one filament are concerned, it is reported as "per single yarn". However, the expression signifies "per single filament" when one filament is involved and, when a multifilament is involved, signifies "per individual single filament" that constitutes the multi-filament.

A feature of the present invention is the fact that a filament with a high degree of molecular orientation of at least 50% measured by birefringence can be used, and the fact that such a original filament with a high degree of orientation can be drawn to a super high draw ratio such as several hundred differentiates the method from other drawing methods. When an original filament is highly oriented as in this case, the drawing is often initiated using an expanded section with a diameter greater than the original filament diameter.

Filaments comprising thermoplastic polymers, for example, polyesters such as poly(ethylene terephthalate), aliphatic polyesters and poly(ethylene naphthalate); polyamides such as nylon (includes nylon 6 and nylon 66); polyolefins such as polypropylene and polyethylene; poly(vinyl alcohol) type polymers; acrylonitrile type polymers; fluorinated polymers such as tetrafluoroethylene.perfluoroalkyl vinyl ether copolymers (PFA); vinyl chloride type polymers; styrene type polymers; polyoxymethylene; ether ester type polymers and the like may be used as the original filament in the present invention. Poly (ethylene terephthalate), nylon (including nylon 6 and nylon 66) and polypropylene are particularly suited for manufacturing the microfilament and the non-woven fabrics comprising the microfilament of the present invention since they have good drawing properties and molecular orientation. In addition, biodegradable polymers and polymers that are degraded and absorbed in vivo such as poly (lactic acid), poly (glycolic acid) and the like and high strength, high elasticity filaments and the like such as polyarylates, aramides and the like are stretched well in the present invention using infrared beams and are particularly suited for manufacturing microfilaments and micro non-woven fabrics of the present invention. Composite filaments such as core-sheath type filaments and the like comprising the polymers may be used in the original filament. Now, the polymers mentioned above are sometimes referred to as polyester "types" and as polymers with polyester as the "main component" when the polymer mentioned above is present in at least 85% (by weight %).

An original filament transferred from a filament transportation device is drawn in the present invention. Various types of transportation device may be used as long as the transportation device can move a filament at a constant speed using a combination of nip rollers and several stages of drived rollers. In addition, when only a filament of constant length needs to be drawn, an original filament may be grasped with a chuck and may be supplied to an orifice after it travels downward at a constant rate.

The original filament moved by a filament transportation device is also allowed to pass through an orifice aided by a gas flow in the direction of the motion. The original filament is in an atmosphere maintained at P1 pressure until the filament is transported into the orifice using the filament transporting device, and the space that is maintained at P1 pressure is referred to as a filament supply chamber. Constant pressure does not particularly need to be maintained when P1 is atmospheric pressure. An enclosure (a chamber) is needed to maintain the pressure when P1 represents an added or reduced pressure, and a pressurizing pump or a pressure reducing pump is needed. The orifice entrance needs to be maintained at P1 in the present invention, but the area in which the original filament is stored and the transportation section of the original filament do not necessarily have to maintain P1. However, maintaining both areas at the same pressure is preferred since installing separate chambers is complicated.

The section downstream from the orifice exit is maintained at P2 and becomes a drawing chamber in which the original filament exiting the orifice is heated using an infrared light beam and is drawn. The original filament is moved inside the orifice by the air flow created by the pressure difference (P1−P2) between the original filament supply chamber at P1 and the drawing chamber maintained at P2. When P2 is atmospheric pressure, the pressure does not need to be maintained at a constant level. When P2 is an added pressure or reduced pressure, an enclosure (a chamber) is needed to maintain the pressure and a pressurizing pump or a pressure reducing pump is also needed.

The difference in P1 and P2 pressures is created when P1>P2. Based on the experimental results, P1≧2P2 is preferred. However, P1≧3P2 is more preferred, and P1≧5P2 is preferred most.

A particularly desirable way to conduct the present invention is for P2 to be under reduced pressure (less than atmospheric pressure). By following this procedure, P1 can be atmospheric pressure and the apparatus can be radically simplified. In addition, reducing the pressure is relatively simple to achieve. Furthermore, air that is ordinarily present at atmospheric pressure does not interfere with the air released from the orifice when it is released into an area of reduced pressure. This allows the released air and the filament accompanying it to be very stable. As a result, the drawing properties are stable, and the drawing can yield filaments with properties in the nanofilament category. In addition, when a high speed fluid is ejected from a nozzle, a large amount of accompanying flow occurs around the nozzle. Such accompanying flow is minimized under reduced pressure, and the filament flow exiting from the nozzle is not disturbed. These factors were thought to play a role in stabilizing the drawing process. A special feature of the present invention is that a filament characterized as a nano micron material is obtained using such a simple means.

Room temperature air is ordinarily used for P1 and P2. However, heated air is used when a manufacturer wants to pre-heat an original filament or wants to heat treat a drawn filament. In addition, an inert gas such as nitrogen and the like is used to prevent filament oxidation and a gas containing water vapor or moisture is also used to prevent moisture loss.

The original filament supply chamber and the drawing chamber in the present invention are connected to the orifice. A high speed gas flow is created inside the orifice by the pressure difference, P1>P2, in the narrow space between an original filament and the internal diameter of the orifice. The internal diameter (D) of the orifice and the diameter (d) of the fiber should not be too different in order to generate a high speed gas flow. According to experimental results, a relative diameter range expressed as $1.2d<D<10d$ is acceptable. However, the range of $1.5d<D<7d$ is preferred, and the range of $2d<D<5d$ is most preferred. When the nozzle diameter is too large in comparison to the filament diameter, the gas flow through the nozzle is not very fast and the P2 pressure is not sufficiently low. In addition, when the nozzle diameter is too close to the filament diameter, air flow resistance is generated, and the speed of the gas flowing through the nozzle does not rise. Furthermore, not only does the diameter of a drawn filament increase as the air flow exceeds the preferred range described above, but also the filament diameter becomes less consistent and lumps tend to form more readily.

The internal orifice diameter (D) refers to the diameter of the orifice exit section. However, the diameter (D) of the narrowest section is used when the orifice cross section is not circular. Similarly, the smallest diameter is used as (d) for a filament diameter when the cross section is not circular. The diameter is ordinarily measured at ten locations using the smallest cross section as the standard, and the mathematical average is used. The lower end of a vertically positioned orifice is designated as the exit since an original filament ordinarily passes from top to bottom. However, the upper exit from an orifice is designated as the exit when an original filament passes from the bottom to the top. Similarly, the exit is located to the side of an orifice when an orifice is positioned horizontally and an original filament passes horizontally.

An orifice interior structure that offers little resistance is preferred since a gas flows through the interior at high speed. The orifice in the present invention does not necessarily need to be cylindrical. Although the orifice cross section is preferably circular, an orifice with an elliptical or rectangular cross section may also be used when multiple numbers of filaments are allowed to pass or when a filament shape is elliptical or rectangular. In addition, the use of an orifice with a large entrance that allows easy access to an original filament in which the exit is the only narrow section is preferred since the resistance to the filament movement is low and the speed of the gas leaving the orifice exit is high.

The role of the orifice in the present invention is different from the role an air supply pipe plays prior to drawing in the previous inventions of the inventors and the like. The air supply pipe was previously used to aim a laser at a fixed position in a filament and played the role of transporting an original filament to the fixed position with as little resistance as possible. The present invention adds to the previous inventions and differs from them in that a high speed regulating gas flow is generated by the pressure difference between pressure P1 in an original filament supply chamber and pressure P2 in a drawing chamber. Now, tension is applied on a molten filament using an air sucker and the like in an ordinary spun bonded non-woven fabrics manufacturing process. However, the action mechanism and effects of the air sucker in spun bonded non-woven fabrics manufacturing process and the orifice in the present invention are completely different. In a spun bonded process, a molten filament is transported using a high speed fluid inside an air sucker and the filament diameter is attenuated almost completely inside the air sucker. In contrast, a solid original filament is transported by an orifice, and attenuating of the filament does not begin inside the orifice. In addition, a high speed fluid is generated by sending high pressure air into an air sucker in a spun bonded fabric production process. The present invention differs in that the high speed fluid inside the orifice is generated by the pressure differential between the chambers before and after the orifice. The effects are also different. The best filament diameter one can expect from the spun bonded fabric production process is about 10 μm, but a nanofilament obtained in the present invention is smaller in diameter than 1 μm making the present invention much more advantageous effectives.

In the present invention, the drawing is preferably conducted at a rate in the speed of sound region. The speed of air leaving an orifice is represented by the following equation (Graham's theorum) where ρ represents air density.

$$v=\{2(P1-P2)/\rho\}^{1/2}$$

Here, the results posted on Table 1 were calculated when P1 was atmospheric pressure and P2 was changed. Based on the results, the air speed (v) is in the speed of sound region (340-400 m/sec) when the reduced pressure zone P2 was 30 kPa, 20 kPa and 6 kPa in the present invention. The results obtained by calculating the ratio (mach M) with the speed of sound are also posted to the table. A microfilament with a filament diameter in the nanometer range can be obtained using the present invention by raising the air speed (v) in a drawing chamber to the speed of sound range when the speed of sound range is defined as the area in which M is at least 0.98.

TABLE 1

The Air Speed

| P2 kPa | V (m/sec) | M at 298.5° K |
|---|---|---|
| 50 | 289 | 0.834 |
| 30 | 342 | 0.987 |
| 20 | 365 | 1.05 |
| 6 | 396 | 1.15 |

The air speed at the orifice exit by the pressure change of the drawing chamber (degree of vacuum)
P1: atmospheric pressure The original filament released from an orifice is heated at the orifice exit using an infrared light beam and is drawn by the tension applied to the filament by the high speed fluid from the orifice. The position directly under the orifice, based on experimental results, refers to the position in which the center of an infrared light beam is located 30 mm or less from the orifice tip. However, 10 mm or less is preferred, and 5 mm or less is most preferred. When a filament leaves the orifice, the original filament vibrates, does not remain in a set position and is not stable enough to be exposed to an infrared light beam. In addition, the tension applied to the filament by the high speed gas released from the orifice becomes weaker as the filament moves away from the orifice. The stability is thought to decrease also.

A feature of the present invention is the heating and drawing of an original filament using an infrared light beam. The infrared rays are defined as radiation with wavelengths of from 0.78 μm to 1 mm. However, the absorption attributed to a C—C bond in polymeric compounds is centered around 3.5 μm, and absorption bands of from 0.78 μm to 20 μm are particularly preferred. The infrared radiation in this zone is focused into a spot or a line using a mirror or a lens, and a heater referred to as a spot heater or line heater that concentrates the heating zone to an original filament can be used. A line heater is ideal when multiple numbers of original filament are moving in parallel lines.

A laser beam is particularly preferred as the infrared light beam in the present invention. Among lasers, carbon dioxide gas lasers with wavelengths of 10.6 μm and YAG (yttrium, aluminum, garnet type) lasers with wavelengths of 1.06 μm are particularly preferred. A laser can narrow the radiation range (light beam) and focuses on a specific wavelength. Therefore, a laser uses energy efficiently. The power density of a carbon dioxide gas laser of the present invention is at least 50 W/cm$^2$, but a power density of at least 100 W/cm$^2$ is preferred and at least 180 W/cm$^2$ is most preferred. The super high draw ratio of the present invention is made possible by the concentration of high density energy power on a narrow drawing zone.

Now, irradiation using an infrared light beam in this case is preferably conducted from multiple locations. The reason for this preference is the difficulties encountered in drawing due to asymmetric heating caused by the heating of a filament from only one side when the melting temperature of a polymer is high, when fusion is difficult to achieve and when a filament is difficult to draw under any condition. Such multiple site irradiations may be achieved by using multiple light sources composed of infrared light beams but may also be accomplished by reflecting the beam from a single light source using mirrors to irradiate multiple times along the passage of an original filament. The mirrors may be fixed mirrors, but a rotating mirror such as a polygon mirror may also be used.

An original filament may be irradiated from multiple locations using multiple light sources as another means of irradiating from multiple locations. Multiple stable low cost laser emitters that are relatively small scale laser beam sources may be used as high powered light sources.

The original filament of the present invention is heated to a temperature suitable for drawing using an infrared light beam irradiated by an infrared heating means (includes lasers). An original filament is heated by the infrared light beam in the present invention. However, the range that is heated to a temperature suited for drawing is preferably within 4 mm up and down (8 mm length) along the filament axis direction in the center of the filament. The range of 3 mm up and down is more preferred, and the range of 2 mm up and down is most preferred. The diameter of the beam is measured along the axis direction of a filament in motion. When multiple original filaments are used, a slit-shaped beam may also be used. In such a case, the narrowest section preferably coincides with the axis direction of the original filament. The present invention was able to draw a filament to a nano range with a high degree of attenuating by suddenly stretching the filament in a narrow zone and was able to minimize the breakage caused by stretching. Now, when the filament irradiated with the infrared light beam is a multi-filament, the center of the filament described above refers to the center of the multi-filament bundle.

A filament drawn according to the present invention may be accumulated in a drawing chamber and removed but can also be wound in terms of an aggregate or non-woven microfilament fabrics by stacking the filament on a moving conveyer. Non-woven fabrics comprising nanofilament can be manufactured in the manner described above. As the conveyer in the present invention, a net-like moving body is ordinarily used, but the filament also may be accumulated on a belt or a cylinder.

Now, a laminated material on a cloth may be manufactured by accumulating the microfilament drawn according to the present invention on a cloth-like material in motion. An accumulated material or non-woven fabrics comprising nanofilament is particularly difficult to handle since the constituting filament is very fine, but the handling is improved when laminated with a cloth-like material in the manner described. In some applications, the filament can be used in applications such as filters and the like without any further treatment when the filament is laminated on commercially available spun bonded non-woven fabrics and the like. As the cloth-like material, a woven material, knit material, non-woven fabrics, felt and the like are used. In addition, the filament may be accumulated on a film in motion.

A filament drawn according to the present invention may be subsequently continuously wound on a bobbin, cheese, hank and the like through guide rollers and the like to prepare a wound product.

The objective of the present invention is to manufacture a microfilament by drawing an original filament using a super high draw ratio. The microfilament in the present invention refers to attenuated filament obtained by drawing an original filament at a ratio of at least one hundred. Of the microfilaments, those with a filament diameter smaller than 1 μm are specifically referred to as nanofilaments. The present invention can yield a nanofilament even from an original filament having a diameter of at least 100 μm by drawing the original filament at a draw ratio of at least 10,000.

The draw ratio (λ) in the present invention is represented by the following equation using the diameter (do) of an original filament and the diameter (d) of the filament after drawing. In this case, the calculation is executed using a constant filament density. The filament diameter is measured using a scanning electron microscope (SEM). A photograph of an original filament was taken at a magnification of 350, and a photograph of a drawn filament was taken at a magnification of 1,000 or more. An average of one hundred sites was reported.

$$\lambda=(do/d)^2$$

One feature of the drawn filament obtained according to the present invention is the uniformity of the filament diameter. The filament diameter distribution was calculated using one hundred measurements on the SEM photograph described above using measurement software. The standard deviation was calculated from the measurement values and was used as a measure of filament diameter distribution.

The molecules in a drawn filament of the present invention become oriented upon drawing, and the filament is thermally stable. The drawn filament of the present invention has a very small filament diameter, and the molecular orientation of the filament is measured with difficulty. The thermal analysis results indicated that the drawn filament of the present invention did not simply become thinner but underwent molecular orientation. The differential thermal analysis (DSC) of an original filament and drawn filament was measured at a heating rate of temperature rise of 10° C./min using a THEM PLUS2 DSC8230 manufactured by Rigaku Co.

Advantageous Effects of the Inventions

The ES method previously used to manufacture nanofibers is complex manufacturing method that requires dissolution of a polymer in a solvent and removal of the solvent from the finished product and contributes to a high manufacturing cost. In addition, the finished product also encounters quality problems such as the presence of resin pieces referred to as lumps and balls, a broad filament diameter distribution and the like. In addition, the fiber obtained was short (staple fiber), and the length ranged from several millimeters to at most several tens of millimeters. However, basically continuous filaments that are at least several meters long can be obtained by using the present invention.

The present invention does not need a special high performance apparatus that operates at high precision, and a microfilament with improved molecular orientation can be obtained readily using a simple means. In addition, a draw ratio of at least 10,000 can be achieved using almost all thermoplastic polymers, and a super fine filament with a diameter of less than 1 μm in the nanofilament range can be manufactured. Furthermore, a super fine filament with a very narrow filament diameter distribution reflected in a standard deviation of 0.1 or lower can be obtained even though the average filament diameter is in the nanofilament range.

The pressure difference upstream and downstream from an orifice is utilized as the means to generate a high speed gas flow that imparts the drawing tension in the super drawing method of the present invention involving an infrared light beam. The approach creates a very stable high speed gas flow and yields not only a nanofilament but also enables a stable continuous operation as far as productivity is concerned.

The drawing process of the present invention is particularly stable due to the reduced pressure in the drawing chamber, and a stable nanofilament manufacturing process can be realized. An air flow released at high speed is not disturbed under reduced pressure, and a stable air flow is thought to be achieved.

In addition, the present invention can present long fiber non-woven fabrics comprising super fine filaments with diameters in the nanofilament range. Furthermore, a laminated material is also obtained by laminating the filament on non-woven fabrics such as commercially available spun bonded non-woven fabrics and the like.

The present invention can yield a super fine filament with a diameter in the nanofilament range from a filament comprising biodegradable polymers used in regenerated medical materials such as poly(lactic acid) and poly(glycolic acid) and the like that ordinarily have poor drawing properties. The ES method previously used to manufacture nanofibers used a solvent such as chloroform and the like, and the method not only required dissolution step and solvent removal step but also used such toxic solvents. The use of such solvents made it difficult to use the filaments in regenerated medical treatment applications.

The nanofilaments obtained according to the present invention not only dramatically improve filter efficiencies in conventional air filter applications but also are adaptable as revolutionary materials with a broad range of applications in IT, bio and environmental fields. Another feature of the present invention is that microfilaments and nanofilaments can be easily obtained from filaments of high performance polymers such as polyarylate type polymers, poly(ethylene naphthalates), fluorinated polymers and the like, previously considered difficult to attenuate due to the narrow range of conditions amenable for spinning and drawing thereof.

DESCRIPTION OF THE PREFERRED EMBODIMENTS

Figure 1:
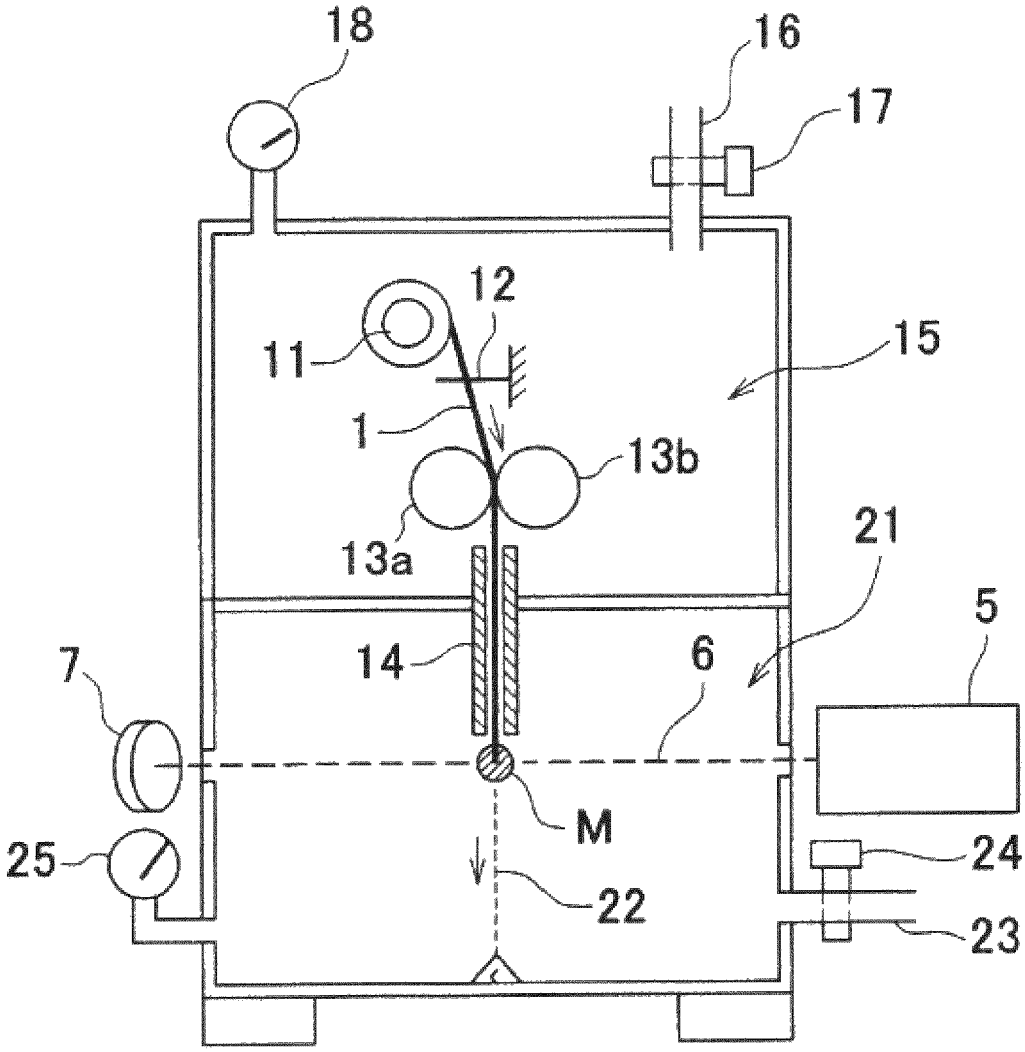
FIG. 1 is a conceptual process diagram for the production of a drawn filament of the present invention.

The execution modes of the present invention are described below based on the figures. FIG. 1 is a conceptual diagram that shows the fundamental basis for the production of microfilaments in the present invention, and a cross section of an apparatus is shown. An original filament 1 is supplied from a reel 11 on which the filament had been wound, the filament is supplied at a constant rate using nip rollers 13*a* and 13*b* through a comb 12 and led to an orifice 14. In the steps up to this point, the original filament supply chamber 15 is maintained at pressure P1. The pressure P1 is adjusted using a duct 16 connected to a pressurizing pump (not illustrated), a valve 17 that controls the degree of pressurization, the rate of rotation of the pressurization pump and the like. Now, when the supply chamber 15 of the original filament is under reduced pressure, a vacuum pump is used in place of the pressurizing pump. A pressure gauge 18) is installed in the original filament supply chamber 15, and the pressure is controlled.

Figure 6:
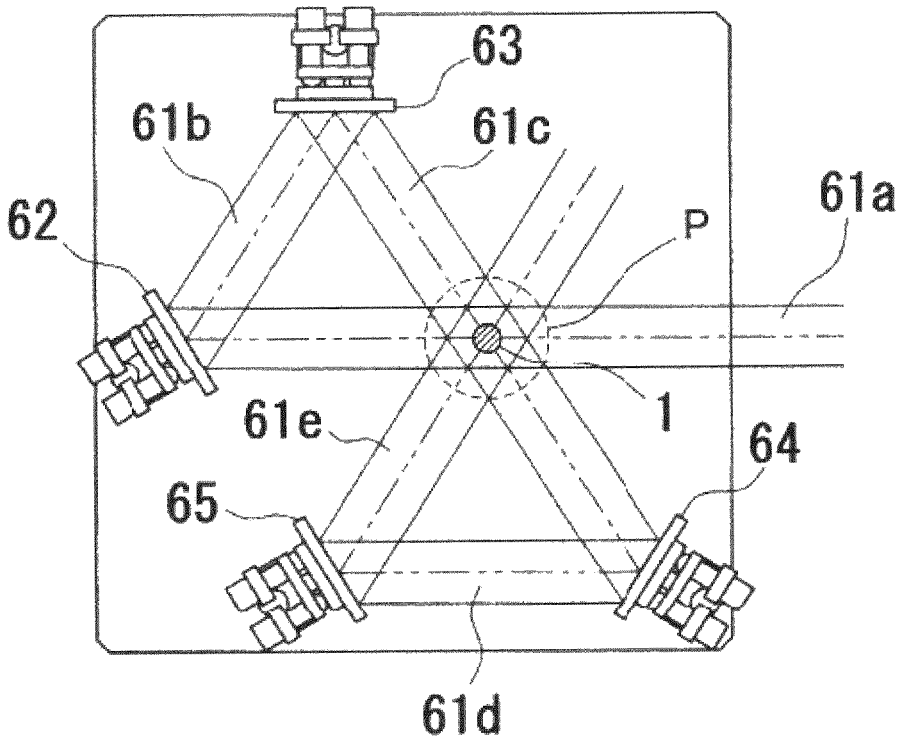
FIG. 6 is a conceptual diagram showing a case in which the infrared ray radiation of the present invention is reflected using a mirror.
Figure 6:
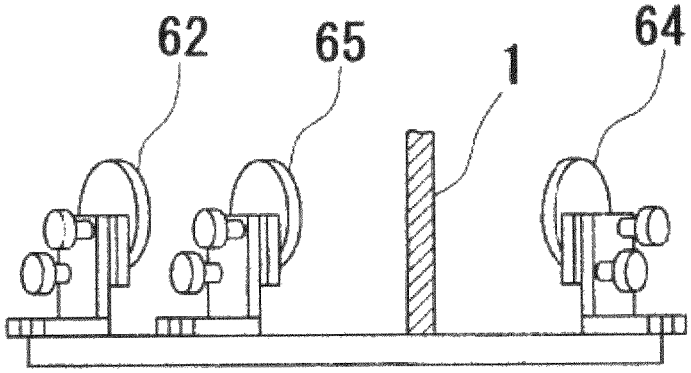
Figure 7:
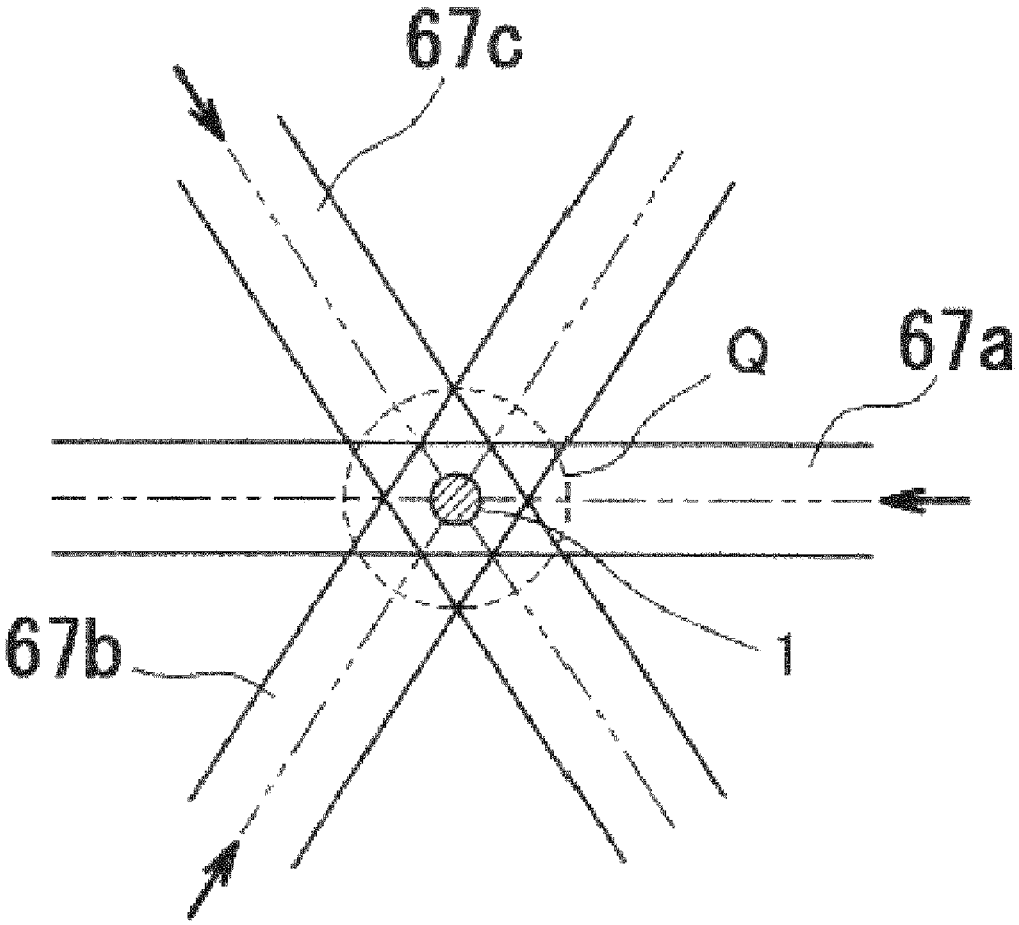
FIG. 7 is a conceptual diagram displaying the state of a light beam when multiple infrared ray irradiation devices of the present invention are used.

A drawing chamber 21 under P2 pressure is located downstream from the orifice 14 exit. The original filament 1 exiting the orifice 14 is introduced into the drawing chamber 21 along with a high speed air flow induced by the pressure difference (P1−P2) between the original filament supply chambers 15 and the drawing chamber. The original filament 1 transferred is irradiated directly under the orifice using a laser generating device 5 with a laser beam 6 in a heating zone M of a constant width to the moving original filament. The laser beam 6 may be irradiated from multiple locations as shown in FIG. 6 and FIG. 7. A laser beam power meter 7 is installed where the laser beam 6 reaches, and the laser power is preferably controlled to a constant level. The original filament is drawn upon heating by the laser beam 6 due to the downward tension on the lower section of the filament applied by the high speed air flow induced by the P1−P2 pressure difference, moves downward in the form of a stretched filament 22 and accumulates below. The pressure P2 is controlled using a duct 23 leading to a vacuum pump (not illustrated), a valve 24 that controls the degree of pressurization, the rotation rate of the vacuum pump, the bypass valves and the like. A pressure gauge 25 is installed in the drawing chamber 21. Now, when the drawing chamber 21 is a pressurized chamber, a pressurization pump is used in place of a vacuum pump.

Figure 2:
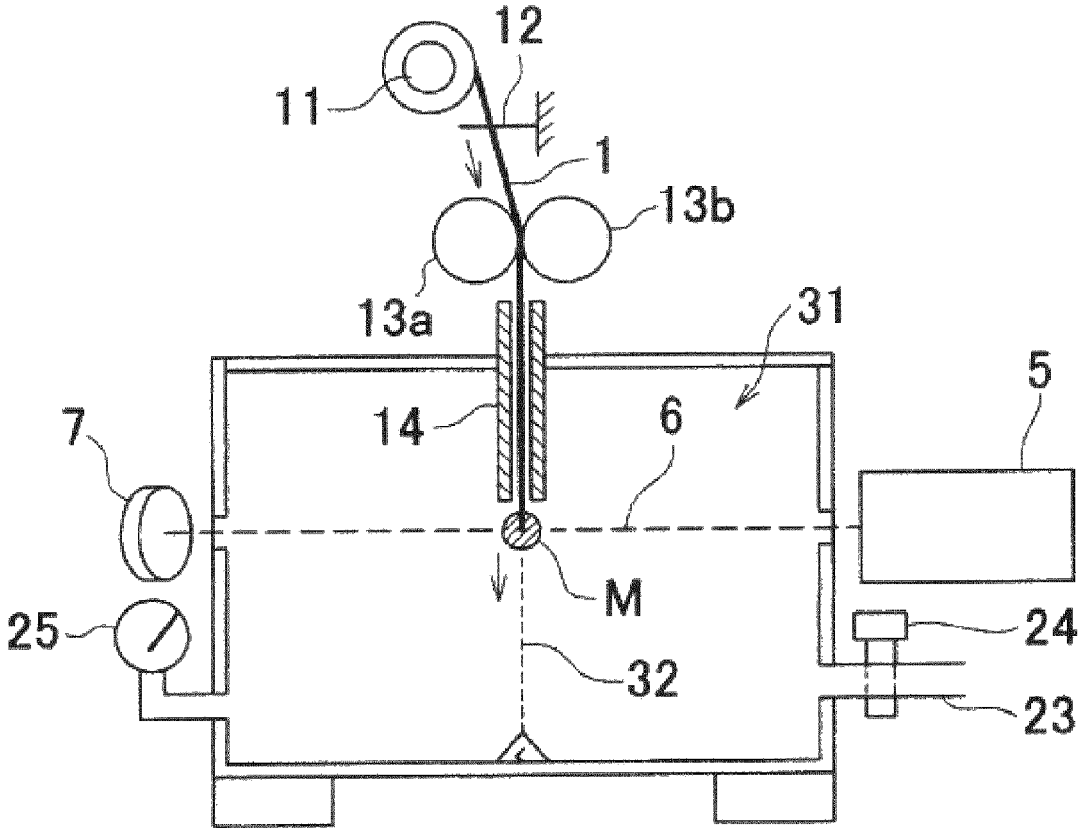
FIG. 2 is a conceptual diagram for an apparatus in which the original filament supply chamber of the present invention is at atmospheric pressure.

FIG. 2 is a cross sectional diagram of an apparatus showing an example in which the pressure, P1, in an original filament supply chamber is atmospheric pressure. The original filament that exits an orifice 14 yields a drawn filament 32 in a drawing chamber 31 through the same steps shown in FIG. 1.

Figure 3:
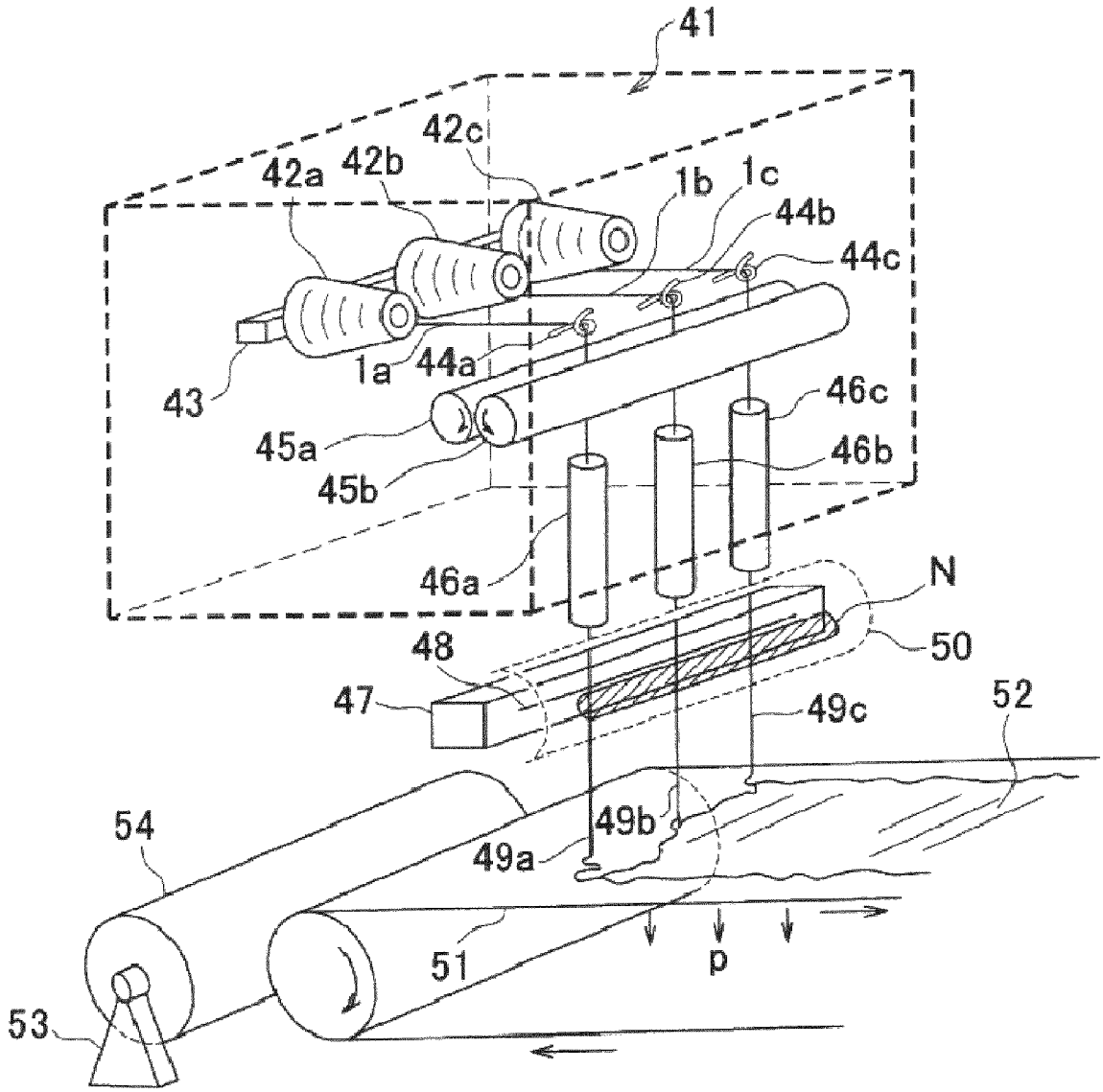
FIG. 3 is a conceptual diagram of an apparatus in which the original filament supply chamber is under added pressure and the drawing chamber is at atmospheric pressure.

FIG. 3 is an angled view of an apparatus seen from the side showing an example in which the original filament supply chamber 41 is a pressurized chamber and the drawing chamber is under atmospheric pressure. Many original filaments 1 are wound on reels 42 and are attached to a platform 43 (only three filaments are shown to avoid complicating the diagram). The original filaments 1*a*, 1*b* and 1*c* are moved by the rotation of transfer nip rollers 45*a* and 45*b* through snail wires 44*a*, 44*b* and 44*c* used as guiding tools and are led to orifices 46*a*, 46*b* and 46*c*. A drawing chamber under P2 pressure that is atmospheric pressure is downstream from the orifice 46 exit and a specific chamber does not need to be installed. The original filament 1 exiting the orifice 46 is transferred to a drawing chamber along with a high speed air flow induced by the pressure difference P1−P2 between the original filament supply chamber 41 and the drawing chamber. The moving original filament 1 is irradiated directly under the orifice with a line of infrared light beams 48 in a heating zone N of a constant width using an infrared ray irradiation device 47. The original filament 1 is drawn by the tension applied to the lower part of the filament by the high speed air flow induced by the P1−P2 pressure difference and moves down in the form of drawn filaments 49*a*, 49*b* and 49*c*. The angled lines show the range of the heating section N of the infrared light beam along the moving route of the original filament 1. The light beam that passes through without being absorbed by the original filament 1 is reflected by the concave mirror 50 shown by the dotted lines and is returned to the heating section N to condense the light. The concave mirror 50 is located on the infrared ray irradiation device 47 side also (however, a window is open in the progression section for the light beam from the infrared ray irradiation device), but the illustration is omitted. The drawn filaments 49*a*, 49*b* and 49*c* accumulate on a moving conveyer 51 and form a web 52. Air is withdrawn in the direction of the arrow (p) from the back side of the conveyer 51 by negative pressure suction and contributes stability to the web 52 movement. The web 52 on the conveyer 51 is pressed or embossed as needed and is wound in the form of non-woven fabrics.

Now, as far as the orifice in FIG. 3 is concerned, cylindrical orifices 46*a*, 46*b* and 46*c* are installed for each of the original filaments. The orifice shown in FIG. 5*b* that can allow numerous original filaments to simultaneously move may also be used as these orifices.

A rolled cloth-like material 54 attached to a platform 53 in FIG. 3 may be transferred to a conveyer, laminated with a web 52 to form a laminated material made from a web comprising microfilaments and a cloth-like material.

Figure 4:
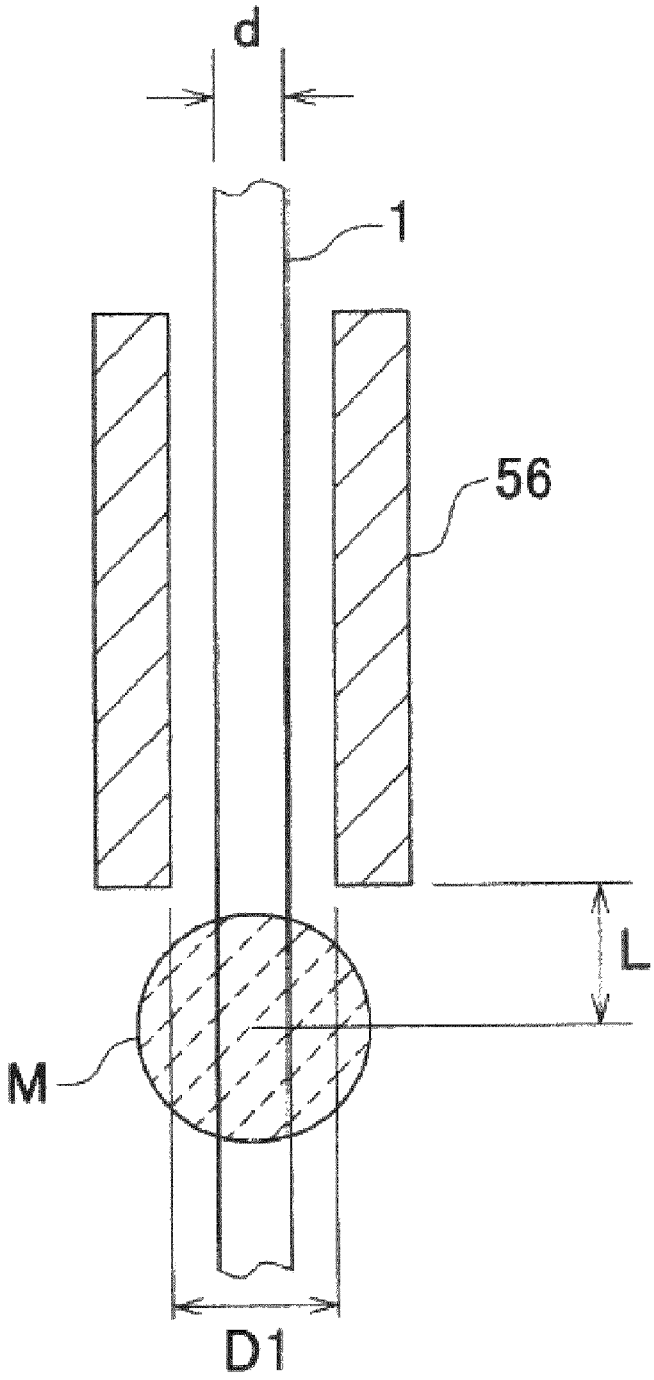
FIG. 4 is a conceptual diagram of an orifice used in the present invention.

FIG. 4 shows a cross sectional view of one example of the orifice used in the present invention. The figure shows an original filament 1 with a filament diameter d exiting a simple cylindrical orifice 56. The internal orifice diameter is D1 at the exit. The filament 1 exiting the orifice is irradiated with an infrared light beam M. The infrared light beam M is positioned so that the distance L from the orifice exit to the center of the infrared light beam M is as short as possible.

Figure 5:
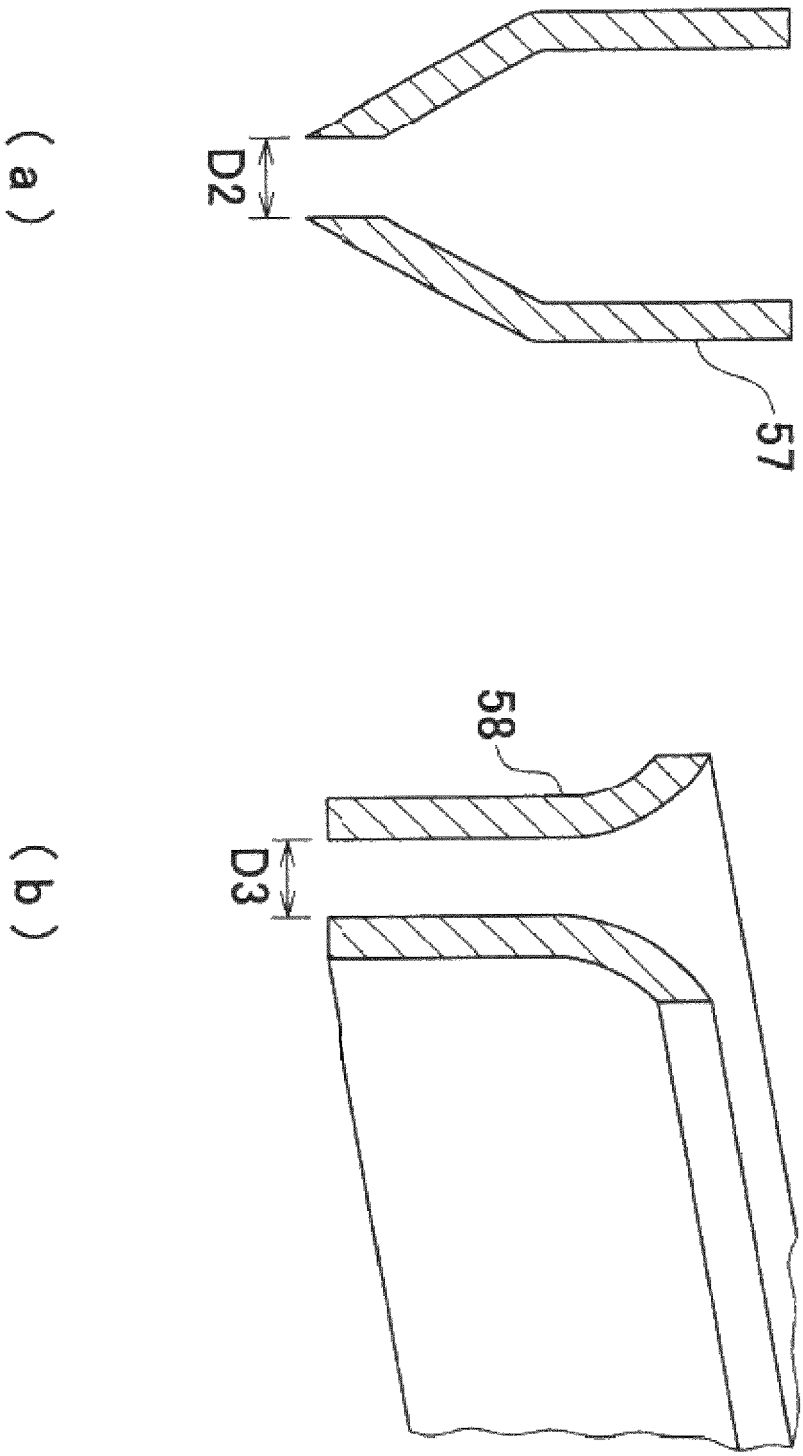
FIG. 5 is a conceptual diagram of an example of another orifice used in the present invention.

Another example of an orifice is shown in the orifice cross section view of FIG. 5. A type of an orifice 57 that has a large orifice entrance with a narrowing exit with an internal diameter of D2 is shown in Fig. (a). An example of an orifice 58 that sends out numerous filaments simultaneously is shown in Fig. (b) with a conceptual diagram of a partial cross section. The exit diameter D3 in Fig. (b) is shown with a diameter in the thickness direction that is the direction of narrowest section.

The infrared light beam used in the present invention is shown in FIG. 6 using an example in which an original filament is irradiated from multiple locations. A view from above is shown in Fig. A, and a side view is shown in Fig. B. The infrared light beam 61*a* radiated by an infrared light beam irradiation device through a zone P (shown using dotted lines in the figure), reaches a mirror 62, becomes an infrared light beam 61*b* upon reflection by the mirror 62 and is again converted into an infrared light beam 61*c* upon reflection by a mirror 63. The infrared light beam 61*c* passes through the zone P and irradiates an original filament at a position one hundred twenty degrees from the initial original filament irradiation location. The infrared light beam that passed through zone P becomes an infrared light beam 61*e* upon reflection by a mirror 65. The infrared light beam 61*e* moves through the zone P and irradiates the original filament 1 at a position one hundred twenty degrees removed from the initial original filament irradiation location for the infrared light beam 61*c*. In the manner described above, an original filament 1 can be evenly heated from symmetrically located positions that are one hundred twenty degrees from each other by generating three infrared light beam 61*a*, 61*b* and 61*c*.

Another example of using an infrared light beam of the present invention in which an original filament is irradiated from multiple locations is shown in FIG. 7. An example in which multiple light sources are used is shown using a plain view. The infrared light beam 67*a* radiated from an infrared ray irradiation device is radiated toward an original filament 1. In addition, an infrared light beam 67*b* radiated from a separate infrared ray irradiation device is also radiated toward the original filament 1. In the manner described above, multiple inexpensive laser transmission devices that are stabilized with relatively small scale light sources may be used as a high power light source to provide radiation from multiple light sources. Now three light sources are shown in the figure, but two may also be used and four or more may also be used. The multiple light sources described above are particularly effective for drawing multiple filaments.

Example 1

Figure 8:
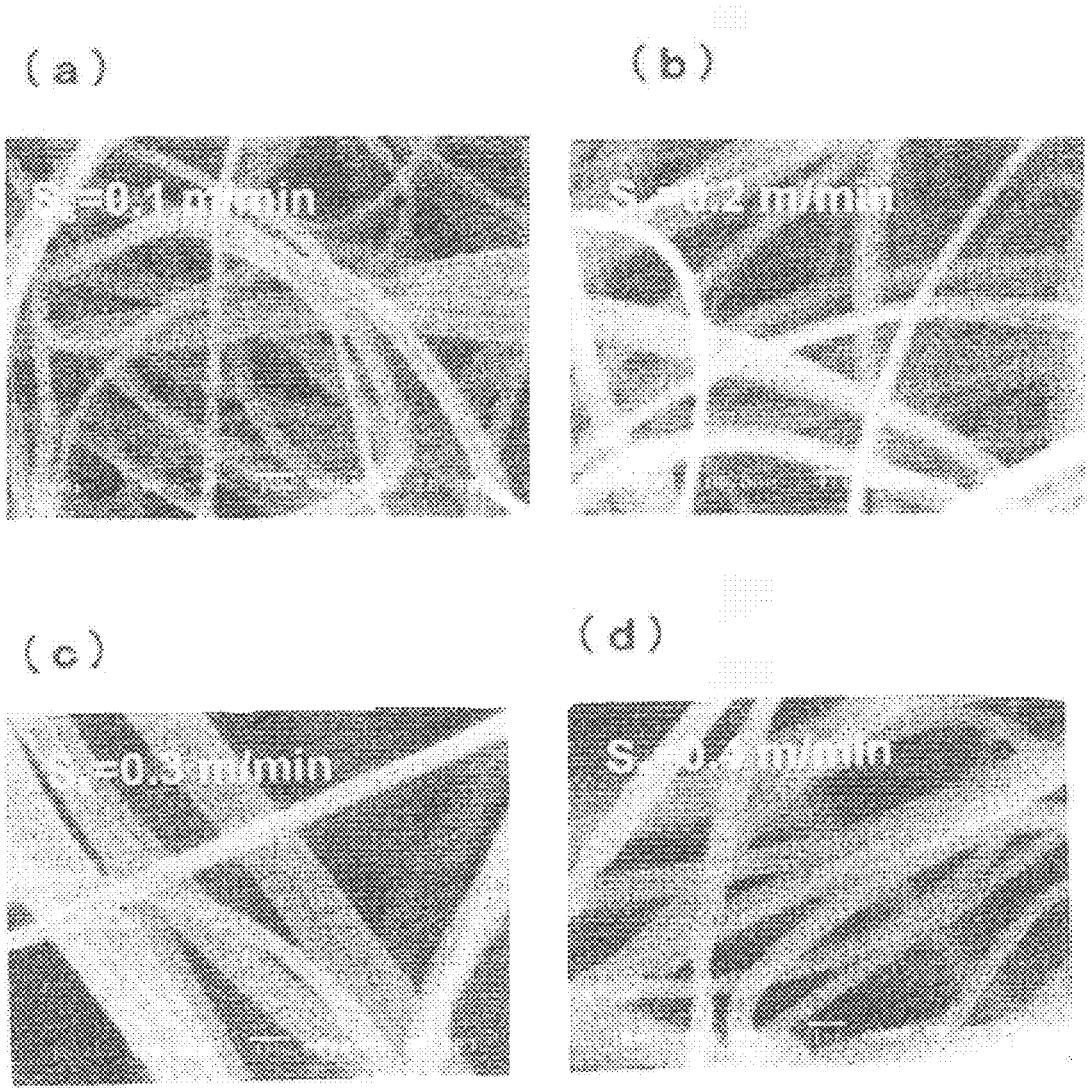
FIG. 8 is a scanning electron microscope photograph (magnification: 10,000) of a poly(ethylene terephthalate) nanofilament drawn by the present invention.
Figure 9:
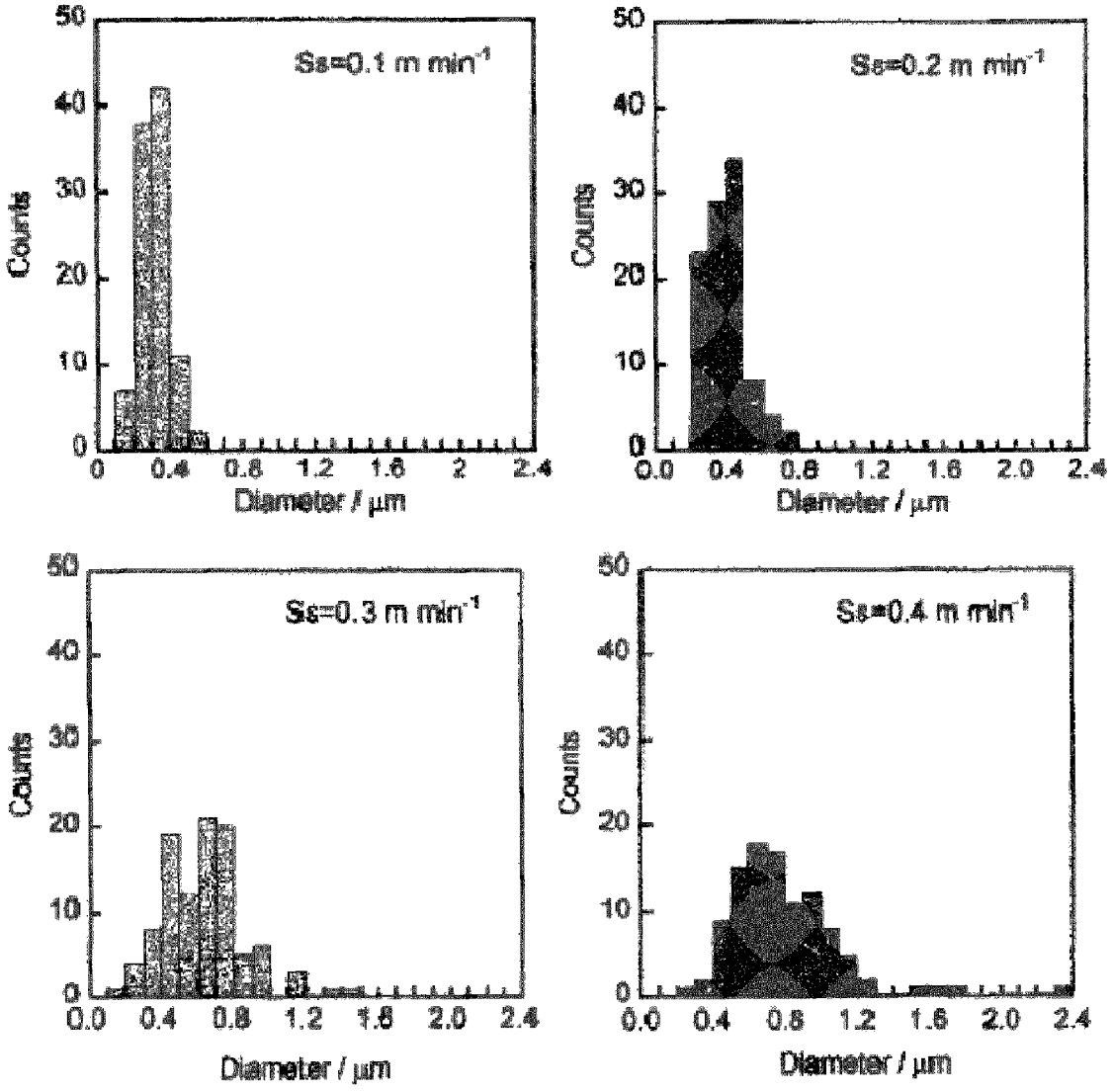
FIG. 9 is a filament diameter distribution diagram for the nanofilament of the present invention shown in FIG. 8.

An undrawn poly(ethylene terephthalate) (PET) filament (filament diameter 182 μm) was used and was drawn using the drawing apparatus shown in FIG. 2. The laser the emitter used at this point was a carbon dioxide laser emitter with laser output of 8 W, and the beam diameter (light beam) was 2.0 mm. The type of orifice shown in FIG. 5*a* was used as the orifice, and the orifice diameter D2 was 0.5 mm. The degree of vacuum in the drawing chamber was adjusted to 8 KPa. The supply speed of the original filament was changed from 0.1 m/min to 0.2 m/min, 0.3 m/min and 0.4 m/min, and the filament diameters of the filaments obtained are shown in Table 2. In addition, the filament diameters when the laser output was changed from two watts to eight watts are also shown. According to the data in the table, a nanofiber with an average filament diameter of 0.313 μm (313 nanometers) was obtained when using eight watts of laser power and a supply speed of 0.1 m/min. The standard deviation for the filament diameter was 0.078 at that point indicating a very uniform filament diameter distribution. Electron microscope photographs (magnification 10,000) of the filaments obtained using these conditions are shown in FIG. 8. The photographs were obtained for filaments prepared under conditions that included a laser output of eight watts and original filament transport rates of 0.1 m/min (a), 0.2 m/min (b), 0.3 m/min (c) and 0.4 m/min (d). Nanofilaments with a filament diameter of less than 1 μm were obtained under other conditions also. The draw ratio reached a factor of 338,100 (about 340,000 fold) since the diameter of the original filament was 180 μm and that of the filament obtained was 0.313 μm. The filament diameter distribution of the filaments obtained under these conditions is shown in FIG. 9. The filament diameters were very even in all cases, and the data in Table 2 indicate that the standard deviation was often 0.3 or less. In good cases, the standard deviation was 0.2 or lower and, in some cases, was 0.1 or lower. Filaments with diameters smaller than 1 μm were obtained under most conditions, and the drawing factor was 33,000 or greater. In addition, the filaments drawn in the manner described above were subjected to DSC, and the results are shown in Table 3.

TABLE 2

| PET | | | | | | | | |
|---|---|---|---|---|---|---|---|---|
| Power Density W/cm$^2$ | Supply Speed 0.1 m/min | | Supply Speed 0.2 m/min | | Supply Speed 0.3 m/min | | Supply Speed 0.4 m/min | |
| 256.6 | max | 0.57 μm | max | 0.78 μm | max | 1.45 μm | max | 2.33 μm |
| (8 W) | min | 0.18 μm | min | 0.22 μm | min | 0.17 μm | min | 0.23 μm |
| | av. | 0.31 μm | av. | 0.39 μm | av. | 0.63 μm | av. | 079 μm |
| | S.D. | 0.078 | S.D. | 0.113 | S.D. | 0.231 | S.D. | 0.307 |
| 191.0 | max | 1.27 μm | max | 1.37 μm | Max | 1.76 μm | max | 1.48 μm |
| (6 W) | min | 0.20 μm | min | 0.16 μm | min | 0.24 μm | min | 0.21 μm |
| | av. | 0.54 μm | av. | 0.47 μm | av. | 0.77 μm | av. | 0.73 μm |
| | S.D. | 0.191 | S.D. | 0.197 | S.D. | 0.278 | S.D. | 0.254 |
| 127.0 | max | 2.52 μm | max | 2.28 μm | Max | 2.18 μm | max | 2.27 μm |
| (4 W) | min | 0.28 μm | min | 0.19 μm | min | 0.52 μm | min | 0.61 μm |
| | av. | 0.79 μm | av. | 0.82 μm | av. | 1.15 μm | av. | 1.13 μm |
| | S.D. | 0.419 | S.D. | 0.368 | S.D. | 0.315 | S.D. | 0.304 |

TABLE 2-continued

| PET | | | | | | | | |
|---|---|---|---|---|---|---|---|---|
| Power Density W/cm$^2$ | Supply Speed 0.1 m/min | | Supply Speed 0.2 m/min | | Supply Speed 0.3 m/min | | Supply Speed 0.4 m/min | |
| 63.7 | max | 2.44 μm | max | 5.13 μm | Max | 6.97 μm | max | 9.46 μm |
| (2 W) | min | 0.56 μm | min | 1.37 μm | min | 1.42 μm | min | 2.54 μm |
| | av. | 1.20 μm | av. | 2.81 μm | av. | 2.96 μm | av. | 4.61 μm |
| | S.D. | 0.395 | S.D. | 0.829 | S.D. | 0.954 | S.D. | 1.035 |

Original filament supply speed and filament diameter (μm)
P2: 8 kPa
S.D.: Standard Deviation

TABLE 3

| PET DSC Measurements | | | | | |
|---|---|---|---|---|---|
| Supply Speed m/min | Power Density W/cm$^2$ | m, p, ° C. | heat of fusion J/g | enthalpy J/g | crystallinity % |
| 0.4 | 256.6 | 257.7 | −47.7 | 17.6 | 23.8 |
| 0.3 | 256.6 | 256.7 | −57.6 | 12.8 | 35.4 |
| 0.2 | 256.6 | 256.9 | −67.4 | 18.8 | 38.4 |
| 0.1 | 256.6 | 256.9 | −54.2 | 10.7 | 34.4 |
| 0.1 | 191.0 | 257.7 | −60.1 | 23.3 | 29.1 |
| 0.1 | 127.0 | 256.7 | −71.1 | 30.4 | 32.2 |
| 0.1 | 63.7 | 257.5 | −60.7 | 23.9 | 29.0 |

(Heating rate of temp. increase 10° C./min)

Example 2

The same undrawn poly(ethylene terephthalate) filament used in Example 1 was used as the original filament. The same drawing chamber and laser emitter used in Example 1 were used. The experiment was conducted using a filament supply speed of 0.1 m/min at different degrees of vacuum for the drawing chamber. When the degree of vacuum was 8 KPa, the average filament diameter was 0.31 μm as shown in Example 1. When the degree of vacuum was 6 KPa, the average filament diameter was 0.42 μm. When the degree of vacuum was 24 KPa, The average filament diameter was 0.82 μm. Filaments with filament diameters less than 1 μm were obtained even under these conditions.

Example 3

Figure 10:
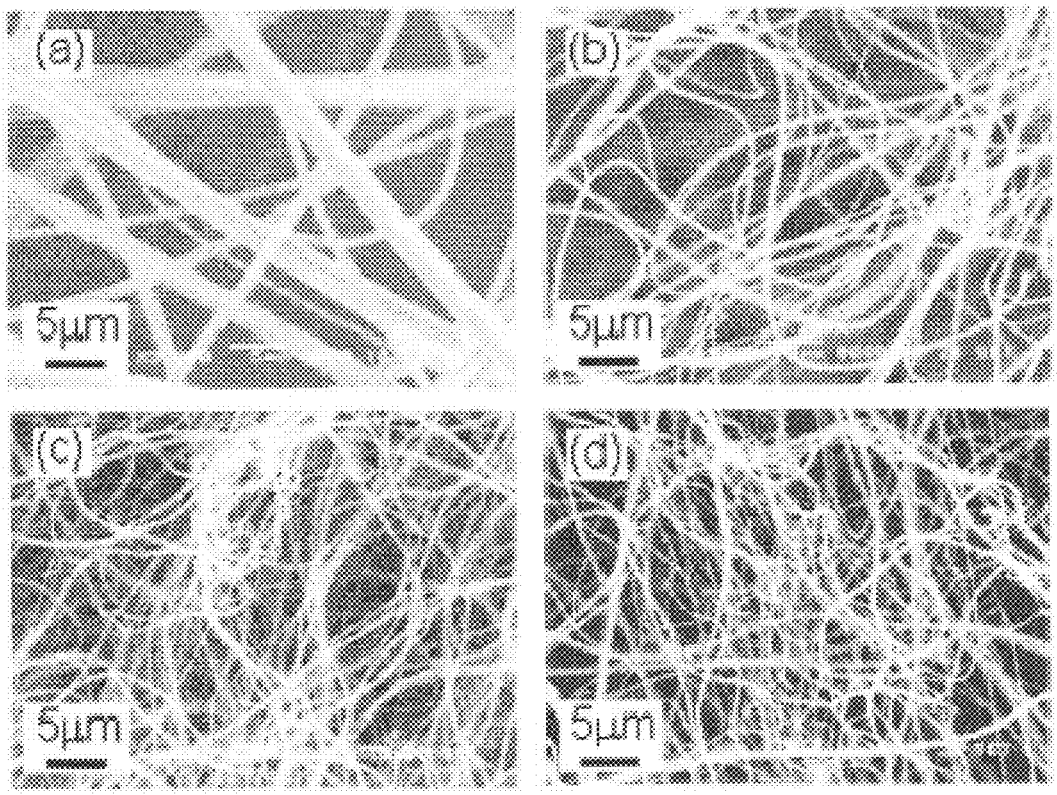
FIG. 10 is a scanning electron microscope photograph (magnification: 3,000) of a poly(lactic acid) nanofilament drawn by the present invention.
Figure 11:
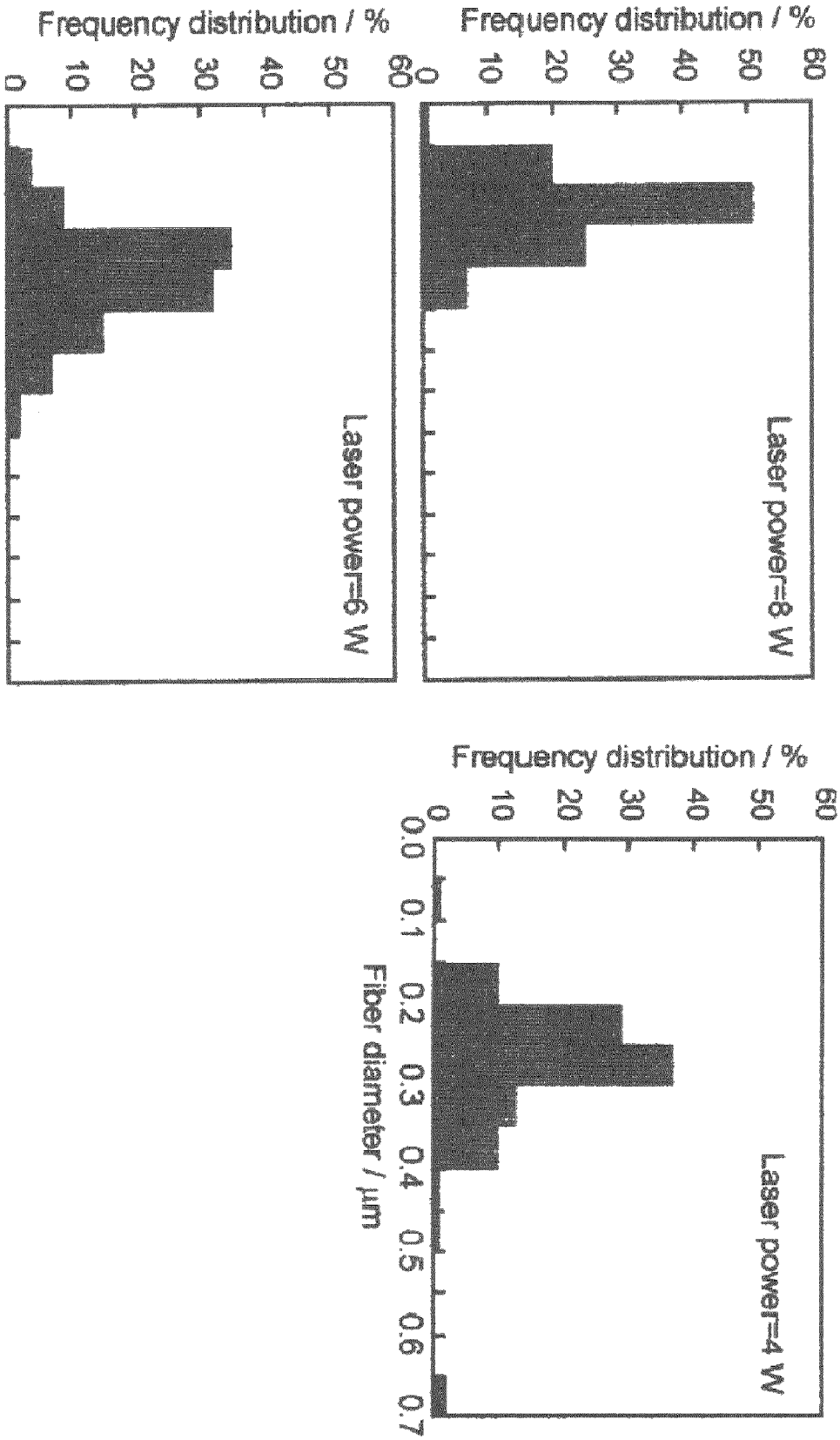
FIG. 11 is a filament diameter distribution diagram for the nanofilament of the present invention shown in FIG. 10.

An undrawn poly(lactic acid) (PLLA) filament (filament diameter 75 μm) was used as the original filament and was drawn using the drawing apparatus of FIG. 2. A carbon dioxide gas laser emitter with a laser output of eight watts was used for this case, and the beam diameter (light beam) was 2.0 mm. The type of orifice described in FIG. 5(*a*) was used as the orifice, and the orifice diameter d2 was 0.5 mm. The degree of vacuum in the drawing chamber was adjusted to 8 kPa. The original filament supply speed was changed from 0.1 m/min to 0.8 m/min, and the filament diameters of the filaments obtained are shown in Table 4. In addition, the filament diameters when the laser output was changed from two watts to eight watts are also shown in the table. According to the data in the table, a nanofiber with an average filament diameter of 0.13 μm (130 nanometer) was obtained when the laser power was eight watts (watt density 256.6 W/cm$^2$) and the supply speed was 0.1 m/min. The filament diameter standard deviation was 0.0356 in this case indicating a very uniform filament diameter distribution. The standard deviation for the drawn filament diameter was 0.2 or lower for most cases when the laser power density was high. Many samples had a standard deviation for the same of 0.1 or lower indicating that the filament diameter was very uniform. A scanning electron microscope photograph (magnification 3,000) of the nanofilament obtained under these conditions is shown in FIG. 10. Nanofilaments with filament diameters less than 1 μm were also obtained under other conditions. The draw ratio reached 322,830 (about 320,000 fold) since the original filament was 75 μm and the filament obtained was 0.13 μm. The filament diameter distribution of the filament obtained under these conditions is shown in FIG. 11. In addition, a filament with a filament diameter less than 1 μm was obtained under most conditions, and the ratio was at least 22,500 when the filament diameter was less than 0.5 μm.

TABLE 4

| PLLA | | | | | | | | |
|---|---|---|---|---|---|---|---|---|
| Power Density W/cm$^2$ | Supply Speed 0.1 m/min | | Supply Speed 0.4 m/min | | Supply Speed 0.6 m/min | | Supply Speed 0.8 m/min | |
| 63.7 | max | 8.41 μm | max | 7.39 μm | max | 23.3 μm | max | 40.0 μm |
| (2 W) | min | 0.58 μm | min | 2.54 μm | min | 2.17 μm | min | 5.10 μm |
| | av. | 1.54 μm | av. | 5.59 μm | av. | 7.52 μm | av. | 13.7 μm |
| | S.D. | 0.842 | S.D. | 1.004 | S.D. | 2.35 | S.D. | 9.40 |
| 127.0 | max | 0.66 μm | max | 0.64 μm | max | 1.50 μm | max | 1.72 μm |
| (4 W) | min | 0.16 μm | min | 0.30 μm | min | 0.27 μm | min | 0.29 μm |
| | av. | 0.27 μm | av. | 0.45 μm | av. | 0.48 μm | av. | 0.69 μm |
| | S.D. | 0.069 | S.D. | 0.074 | S.D. | 0.140 | S.D. | 0.254 |
| 191.0 | max | 0.36 μm | max | 0.73 μm | max | 0.69 μm | max | 0.66 μm |
| (6 W) | min | 0.08 μm | min | 0.15 μm | min | 0.14 μm | min | 0.15 μm |
| | av. | 0.21 μm | av. | 0.36 μm | av. | 0.36 μm | av. | 0.36 μm |
| | S.D. | 0.058 | S.D. | 0.109 | S.D. | 0.109 | S.D. | 0.117 |

TABLE 4-continued

| PLLA | | | | | | | |
|---|---|---|---|---|---|---|---|
| Power Density W/cm$^2$ | Supply Speed 0.1 m/min | | Supply Speed 0.4 m/min | | Supply Speed 0.6 m/min | | Supply Speed 0.8 m/min |
| 256.6 (8 W) | Max | 0.23 μm | max | 0.56 μm | max | 1.05 μm | |
| | min | 0.5 μm | min | 0.11 μm | min | 0.10 μm | |
| | av. | 0.3 μm | av. | 0.29 μm | av. | 0.31 μm | |
| | S.D. | 0.036 | S.D. | 0.098 | S.D. | 0.171 | |

Original filament supply speed and filament diameter (μm)
P2: 8 kPa
S.D.: Standard Deviation

Example 4

Figure 12:
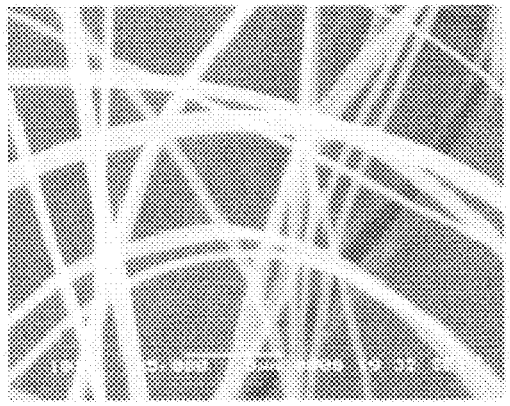
FIG. 12 is a scanning electron microscope photograph (magnification: 5,000) of a PFA filament drawn by the present invention.
Figure 12:
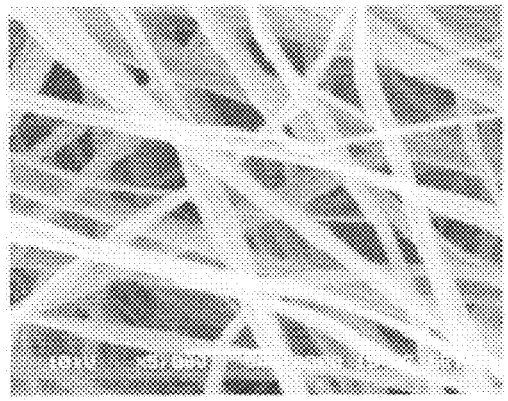
Figure 12:
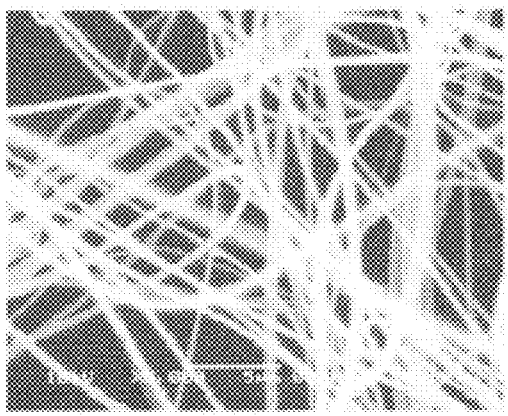
Figure 12:
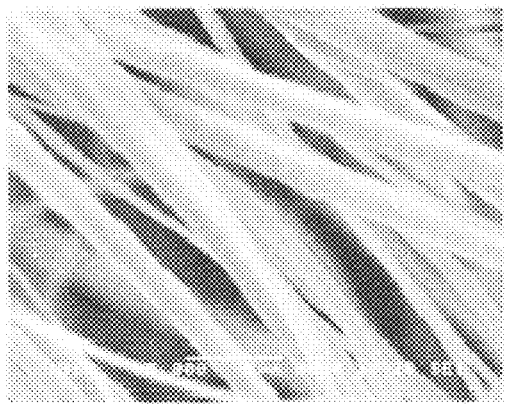

A filament (filament diameter 100 μm) comprising an undrawn tetrafluoroethylene.perfluoroalkyl vinyl ether copolymer (PFA) was used as the original filament, and the drawing was conducted using the drawing apparatus of FIG. 2 to initially obtain a drawn filament with a diameter of 6 μm (filament after primary drawing, ratio 277.8 fold). A secondary drawing was conducted on the filament from the primary drawing using the apparatus shown in FIG. 2. The laser emitter and the like used in this case were the same devices used in Example 1. The type of orifice described in FIG. 5(*a*) was used as the orifice, and the orifice diameter d2 was 0.5 mm. The degree of vacuum in the drawing chamber was adjusted to 6 kPa. The filament diameters and the standard deviations for the filament diameters for the filaments obtained when the supply speed for the primary drawn filament was changed from 0.1 m/min to 0.2 m/min, 0.3 m/min and 0.4 m/min are shown in Table 5. A drawn nanofiber with a filament diameter of less than one micron was obtained. The standard deviations for many of the filaments were 0.1 or lower indicating that the filament diameters were very uniform. In addition, the filament was drawn by a ratio of at least one hundred even when the secondary drawing only was used, and some filaments were drawn by a ratio of at least four thousand. In addition, the draw ratio was at least ten thousand (ratio of ten thousand) in terms of total draw ratio (primary draw ratio×secondary draw ratio), and some were drawn to a draw ratio of at least one million (multiple of one million). A scanning electron microscope photograph (magnification five thousand) of a drawn filament is shown in FIG. 12. The DSC experimental results for the filaments listed in Table 6 are also shown. The fusion calories increased with the decreasing average filament diameter, and the melting point was found to rise slightly.

TABLE 5

| PFA | | | | |
|---|---|---|---|---|
| | Supply Speed m/min | | | |
| | 0.1 | 0.2 | 0.3 | 0.4 |
| max μm | 0.67 | 0.69 | 0.72 | 0.71 |
| min μm | 0.067 | 0.099 | 0.19 | 0.22 |
| av. μm | 0.093 | 0.19 | 0.26 | 0.35 |
| second draw ratio | 4,161 | 997 | 529 | 300 |
| total draw ratio | 1,155,914 | 276,842 | 146,743 | 83,526 |
| Standard Deviation | 0.029 | 0.046 | 0.98 | 0.101 |

Original filament supply speed and filament diameter (μm)
P2: 6 kPa

TABLE 5-continued

| PFA | | | | |
|---|---|---|---|---|
| | Supply Speed m/min | | | |
| | 0.1 | 0.2 | 0.3 | 0.4 |

Power Density: 254.6 W/cm$^2$
first draw ratio: 227.8

TABLE 6

| PFA DSC Measurements | | |
|---|---|---|
| Supply Speed m/min | heat of fusion J/g | m.p. ° C. |
| 0.1 | −17.7 | 304.6 |
| 0.2 | −16.7 | 303.8 |
| 0.3 | −15.3 | 303.5 |
| 0.4 | −15.2 | 302.4 |

(Power Density: 254.6 W/cm$^2$)

Example 5

The filament obtained after the primary drawing in Example 4 was used as the sample, and the apparatus shown in FIG. 1 was used. A pressurizing pump was used to raise the pressure (P1) in the original filament supply chamber to 120 kPa. The pressure (P2) in the drawing chamber was set at 44 kPa, 30 kPa and 26 kPa for experiments using a vacuum pump. The results are shown in Table 7. Other conditions used were the same as those used in Example 4. Nanofilaments with an average filament diameter of less than 1 μm were obtained in these experiments. The standard deviation for the filament diameters was 0.2 or lower while the filament diameter was 0.097 μm and the filament diameter standard deviation was 0.03 when the degree of vacuum was high for P2.

TABLE 7

| PFA | | | | |
|---|---|---|---|---|
| P2 pressure | max filament (μm) | mini filament (μm) | av. filament (μm) | Standard Deviation |
| 26 kPa | 0.652 | 0.058 | 0.097 | 0.031 |
| 30 kPa | 0.715 | 0.215 | 0.270 | 0.115 |
| 44 kPa | 1.211 | 0.428 | 0.515 | 0.181 |

Original filament supply speed: 0.1 m/min
P1: 120 kPa
Power Density: 254.6 W/cm$^2$ Example 6

Figure 13:
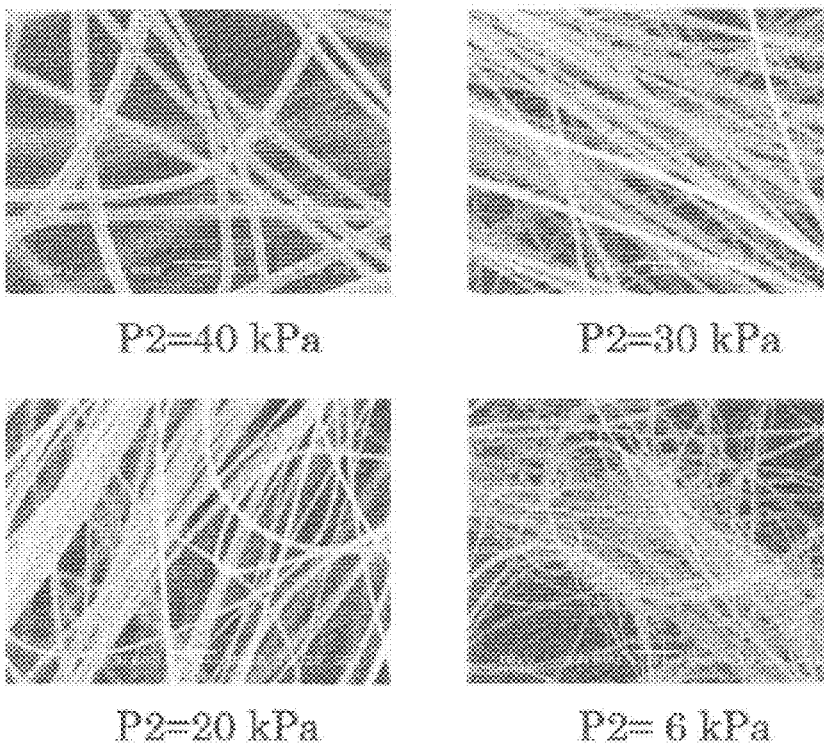
FIG. 13 is a scanning electron microscope photograph (magnification: 1,500) of a PEN filament drawn by the present invention.

A filament (filament diameter 170 μm) comprising an undrawn poly(ethylene 2,6-naphthalate) (PEN) was used as the original filament, and the drawing was conducted using the drawing apparatus shown in FIG. 2. The same laser emitter and the like used in Example 1 were used in this case. The beam diameter was 2.4 mm, and the beam was brought closer directly under the orifice so that the edge of the beam came in contact, and the center of the beam was used for irradiation 1.2 mm directly under the orifice. When the location at which the beam was used was moved 2 mm away while P2 in Table 8 was 6 kPa, the average filament diameter was 0.295 μm and the standard deviation was 0.075. When the location was moved an additional 6 mm, the average filament diameter was 0.410 μm, and the standard deviation was 0.074, indicating the importance of irradiating an original filament with a beam extremely close to the orifice exit. The type of orifice shown in FIG. 5*a*) was used, and the orifice diameter (d2) was 0.5 mm. Table 8 shows the experimental results when P1 was atmospheric pressure and P2 was changed. When P2 was 30 kPa or lower, the average filament diameter was less than one micron. The filament standard deviation was 0.1 or lower indicating how very uniform the filament diameter was in spite of the fact that the filament obtained was such a fine nanofilament. When P2 was 30 kPa or lower, the draw ratio was at least ten thousand and was found to be at least twenty-eight thousand. A scanning electron microscope photograph (magnification 1,500) of the filament obtained using the conditions shown in Table 8 are shown in FIG. 13.

TABLE 8

| PEN | | | | | |
|---|---|---|---|---|---|
| P2 pressure | max filament (μm) | mini filament (μm) | av. filament (μm) | draw ratio | Standard Deviation |
| 6 kPa | 0.400 | 0.120 | 0.259 | 149,073 | 0.054 |
| 20 kPa | 0.660 | 0.330 | 0.463 | 46,648 | 0.062 |
| 30 kPa | 0.760 | 0.420 | 0.595 | 28,247 | 0.064 |
| 40 kPa | 1.720 | 0.850 | 1.186 | 7,110 | 0.187 |

Original filament supply speed: 0.1 m/min
Original filament diameter: 100 μm
Power Density: 177 W/cm$^2$ Example 7

Figure 14:
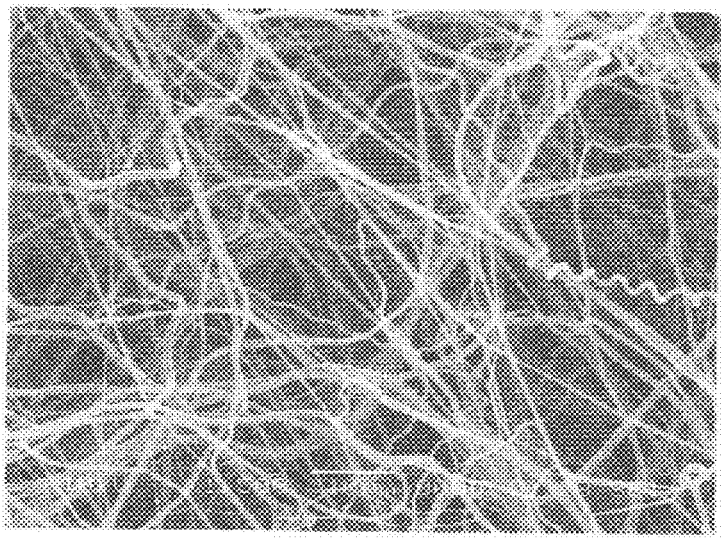
FIG. 14 is a scanning electron microscope photograph (magnification: 3,000) of a PGA filament drawn by the present invention.

A filament (filament diameter 100 μm) comprising undrawn poly(glycolic acid) (PGA) was used as the original filament and was drawn using the drawing apparatus shown in FIG. 2. The same laser emitter and the like used in Example 1 were used in this case. The laser power density was 177 W/cm$^2$, and a beam with a beam diameter of 2.4 mm was used for the irradiation 1.2 mm directly below the orifice. The type of orifice shown in FIG. 5(*a*) was used as the orifice, and the orifice diameter (d2) was 0.5 mm. The degree of vacuum in the drawing chamber was adjusted to 6 kPa. The filament diameters of the filaments obtained when the original filament supply speeds were changed from 0.1 m/min to 0.4 m/min, 0.8 m/min and 1.2 m/min are shown in Table 9. The data in the table indicates that nanofilament with an average filament diameter of 0.388 μm (388 nanometer) was obtained when the supply speed was 0.1 m/min, and the standard deviation for the filament diameter at the time was 0.096 indicating a very uniform filament diameter distribution. The scanning electron microscope photograph (magnification 3,000) of the nanofilaments obtained under the conditions is shown in FIG. 14. Nanofilaments with filament diameters less than 1 μm were obtained under other conditions. The original filament was 100 μm, and the filament obtained was 0.388 μm. Therefore, the draw ratio reached 66,418 (about 66,000). The filament diameters were also uniform under other conditions, and the standard deviation was 0.2 or lower. In addition, filaments smaller than 1 μm were obtained under all conditions, and the draw ratios were at least 10,000 but also could be at least 100,000.

TABLE 9

| PGA | | | | |
|---|---|---|---|---|
| | Supply Speed m/min | | | |
| | 0.1 | 0.4 | 0.8 | 1.2 |
| max μm | 0.670 | 1.200 | 0.870 | 1.430 |
| min μm | 0.240 | 0.190 | 0.250 | 0.190 |
| av. μm | 0.388 | 0.464 | 0.482 | 0.537 |
| draw ratio | 191,951 | 134,234 | 124,396 | 100,218 |
| Standard Deviation | 0.096 | 0.123 | 0.137 | 0.172 |

Original filament supply speed and filament diameter (μm)
P2: 6 kPa
Power Density: 177 W/cm$^2$

INDUSTRIAL APPLICABILITY

The microfilament of the present invention can not only be used in air filters and the like in which conventional microfilaments have been used, but also as a revolutionary material in a broad range of applications such as medical filters, IT performance materials and the like.

The invention claimed is:

1. A method for manufacturing a microfilament, comprising the steps of supplying an original filament to an orifice under P1 pressure using a filament transfer means, then heating the filament under P2 pressure (P1>P2) using an infrared light beam and drawing the filament, wherein drawing tension is generated by a gas flow derived from a pressure difference between P1 and P2, wherein the center of said infrared light beam is radiated on the original filament within 30 mm of the exit of the orifice, and wherein the pressure difference between P1 and P2 before and after said orifice is P1≧2P2.

2. A method for manufacturing a microfilament according to claim 1, wherein the draw ratio in said drawing step is at least 10,000, and the filament diameter after the drawing is less than 1 μm.

3. A method for manufacturing a microfilament according to claim 1, wherein said pressure P2 is lower than 101.3 kPa.

4. A method for manufacturing a microfilament according to claim 1, wherein the air speed inside said orifice is at least 342 m/sec.

5. A method for manufacturing a microfilament according to claim 1, wherein said infrared light beam is used to heat the center of said original filament within a 4 mm range up and down along the filament axis.

6. A method for manufacturing a microfilament according to claim 1, wherein when the internal diameter D of the exit section and the diameter d of said original filament satisfies the relationship 1.2d<D<10d.

7. A method for manufacturing a non-woven fabric comprising the microfilament according to claim 1, obtained by accumulating said drawn filament on a moving conveyer.

8. A method for manufacturing a laminated material and a cloth-like material of the microfilament according to claim 1, obtained by accumulating said drawn filament on said cloth-like material in motion.

9. A method for manufacturing a microfilament according to claim 1, wherein said drawn filament is continuously wound.

10. A manufacturing apparatus for a microfilament comprising;

an original filament supply chamber under pressure P1 containing a means to transfer the original filament, an orifice positioned in said original filament supply chamber through which said original filament passes, a drawing chamber, connected to said original filament supply chamber through said orifice, within which said original filament that passed through said orifice is heated using an infrared light beam and drawn, and wherein the drawing chamber under pressure P2 wherein the pressure difference between P1 and P2 is P1≧2P2 and drawing tension is generated by a gas flow derived from the pressure difference, and an infrared ray irradiation device that radiates said infrared light beam so that the center of the light beam focuses on said original filament within 30 mm of the exit of said orifice.

11. A manufacturing apparatus for a microfilament according to claim 10, wherein the pressure difference is set so that the air speed inside said orifice is at least 342 m/sec.

12. A manufacturing apparatus for a microfilament according to claim 10, wherein said original filament supply chamber is under atmospheric pressure and said drawing chamber is under reduced pressure.

13. A manufacturing apparatus for a microfilament according to claim 10, wherein the apparatus is constructed so that the light beam radiated from said infrared light beam irradiation device focuses on the center of said original filament within 4 mm range up and down along the filament axis direction.

14. A manufacturing apparatus for a microfilament according to claim 10, wherein said infrared light beam is a laser beam and said infrared ray irradiation device is a laser emitter.

15. A manufacturing apparatus for a microfilament according to claim 10, wherein said infrared ray irradiation device contains a mirror that reflects the same light beam and irradiates said original filament from multiple locations on said original filament.

16. A manufacturing apparatus for a microfilament according to claim 10, wherein said infrared ray irradiation device contains multiple light sources that irradiate said original filament from multiple locations.

17. A manufacturing apparatus for a microfilament according to claim 10, wherein the internal diameter D of said orifice exit, said original filament diameter is d and D and d satisfy the relationship $1.2d<D<10d$.

18. A manufacturing apparatus for non-woven fabrics comprising the microfilament according to claim 10, wherein said apparatus is constructed so that a moving conveyer is installed in said drawing chamber and said drawn filament is allowed to accumulate on said conveyer.

19. A manufacturing apparatus for a microfilament according to claim 10, wherein said drawing chamber is equipped with a filament winding device.

* * * * *